US008543040B2

(12) United States Patent
Suzuki et al.

(10) Patent No.: US 8,543,040 B2
(45) Date of Patent: Sep. 24, 2013

(54) POWDER STORAGE CONTAINER, DEVELOPING DEVICE USING POWDER STORAGE CONTAINER, IMAGE FORMING UNIT, AND IMAGE FORMING APPARATUS

(75) Inventors: Toshiaki Suzuki, Kanagawa (JP); Kazuhiro Saito, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 380 days.

(21) Appl. No.: 12/874,822

(22) Filed: Sep. 2, 2010

(65) Prior Publication Data

US 2011/0236075 A1 Sep. 29, 2011

(30) Foreign Application Priority Data

Mar. 24, 2010 (JP) ..... 2010-068444

(51) Int. Cl.
*G03G 15/08* (2006.01)

(52) U.S. Cl.
USPC ..... 399/262; 399/120

(58) Field of Classification Search
USPC ..... 399/120, 262
See application file for complete search history.

(56) References Cited

U.S. PATENT DOCUMENTS 5,298,952 A 3/1994 Kamijo et al.

FOREIGN PATENT DOCUMENTS

| | | | |
|---|---|---|---|
| EP | 1 376 266 | A1 | 1/2004 |
| JP | 57-3250 | U | 1/1982 |
| JP | 61-132311 | U | 8/1986 |
| JP | 62-21179 | A | 1/1987 |
| JP | 2-75660 | U | 6/1990 |
| JP | 3-50580 | A | 3/1991 |
| JP | 5-303278 | A | 11/1993 |
| JP | 2000-155457 | A | 6/2000 |
| JP | 2004-354451 | A | 12/2004 |
| JP | 2004-361463 | A | 12/2004 |

OTHER PUBLICATIONS

Australian Office Action, dated Apr. 19, 2011, issued in Application No. 2010219342.

Communication dated Jan. 31, 2012, issued by the Japanese Patent Office in corresponding Japanese Patent Application No. 2010-068444.

*Primary Examiner* — David Gray
*Assistant Examiner* — Andrew Do
(74) *Attorney, Agent, or Firm* — Sughrue Mion, PLLC

(57) ABSTRACT

A powder storage container includes a powder storage unit, a conveying member, and an elastic member. The powder storage unit stores powder. The conveying member is rotatably disposed in the powder storage unit and conveys the powder stored in the powder storage unit to an outlet. The elastic member includes: an upper end portion fixed to the inside of the powder storage unit; and a lower end portion which is a swingable free end and is disposed above the conveying member. A part of the lower end portion along the conveying direction of the conveying member is configured to contact with the conveying member to be elastically deformed.

11 Claims, 16 Drawing Sheets

POWDER STORAGE CONTAINER, DEVELOPING DEVICE USING POWDER STORAGE CONTAINER, IMAGE FORMING UNIT, AND IMAGE FORMING APPARATUS

CROSS-REFERENCE TO RELATED APPLICATIONS

This application is based upon and claims priority under 35 USC 119 from Japanese Patent Application No. 2010-068444, filed Mar. 24, 2010.

BACKGROUND

Technical Field

The present invention relates to a powder storage container, a developing device using the powder storage container, an image forming unit, and an image forming apparatus.

SUMMARY OF THE INVENTION

According to an aspect of the invention, a powder storage container includes a powder storage unit, a conveying member, and an elastic member. The powder storage unit stores powder. The conveying member is rotatably disposed in the powder storage unit and conveys the powder stored in the powder storage unit to an outlet. The elastic member includes: an upper end portion fixed to the inside of the powder storage unit; and a lower end portion which is a swingable free end and is disposed above the conveying member. A part of the lower end portion along the conveying direction of the conveying member is configured to contact with the conveying member to be elastically deformed.

BRIEF DESCRIPTION OF THE DRAWINGS

Exemplary embodiments of the invention will be described in detail based on the following figures, wherein.

DETAILED DESCRIPTION

An exemplary embodiment of the invention will be described below with reference to drawings.

First Exemplary Embodiment

Figure 2:
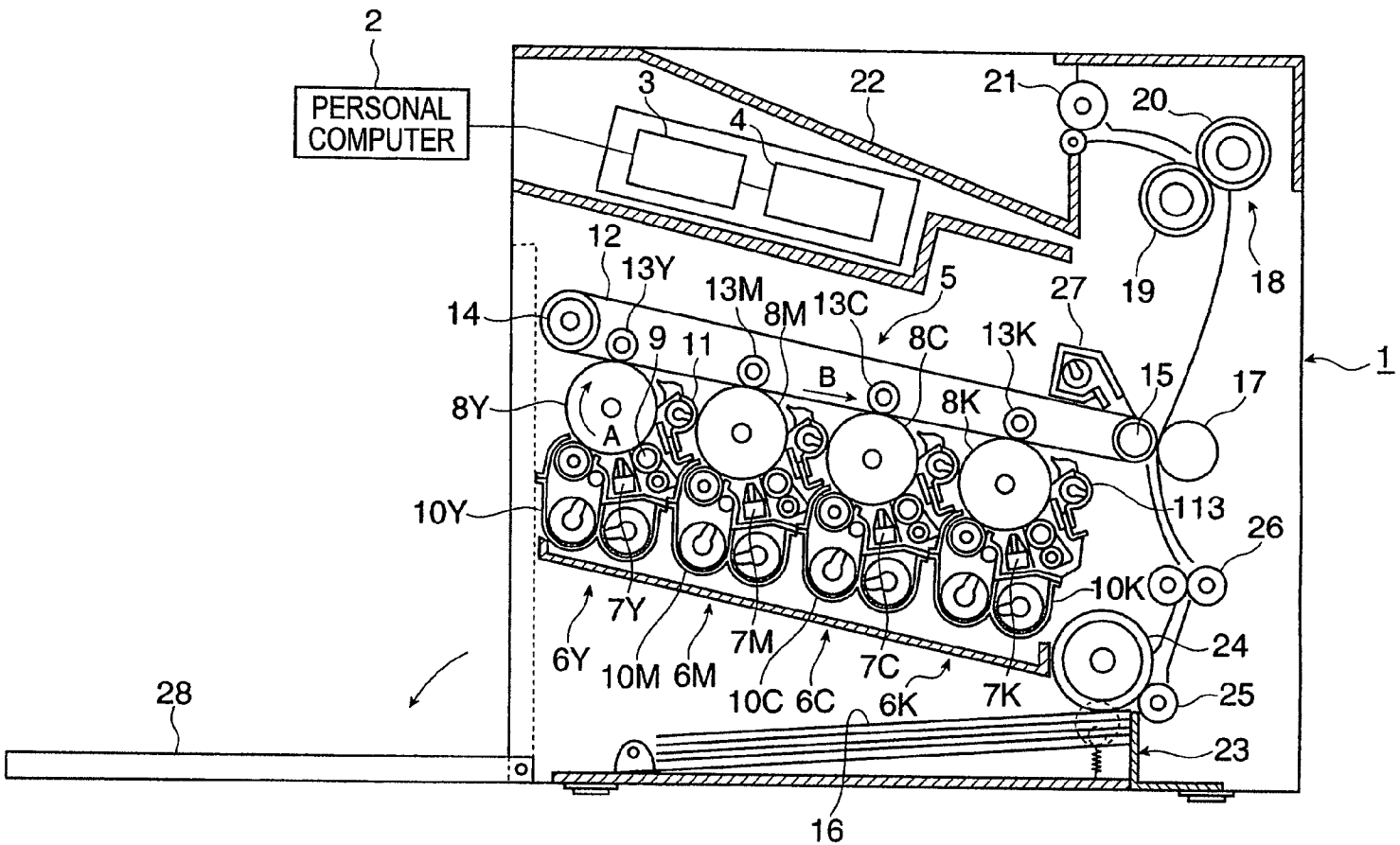
FIG. 2 is a view showing the structure of a tandem type color printer as an image forming apparatus to which the powder storage container according to the first exemplary embodiment of the invention is applied.
Figure 3:
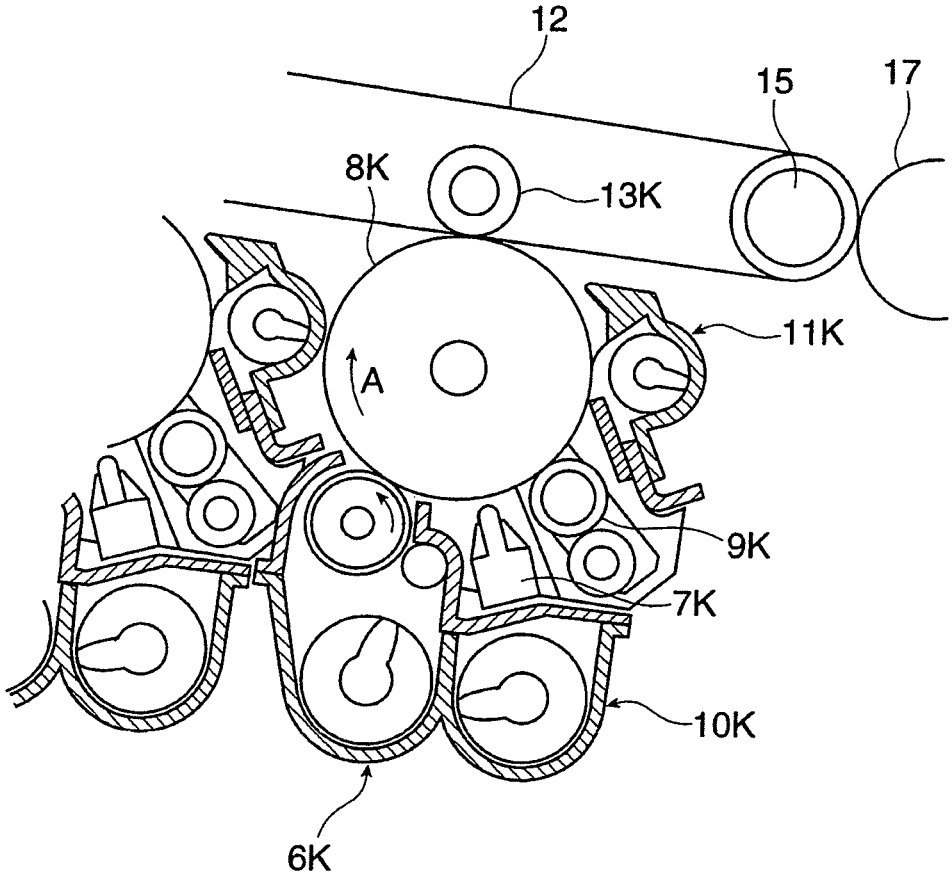
FIG. 3 is a view showing the structure of an image forming section of the tandem type color printer as the image forming apparatus to which the powder storage container according to the first exemplary embodiment of the invention is applied.

FIG. 2 is a view showing the structure of a powder storage container according to a first exemplary embodiment of the invention, a developing device, and a tandem type color printer as an image forming apparatus to which an image forming unit is applied. Further, FIG. 3 is a view showing the structure of the image forming section of the color printer.

As shown in FIG. 2, the color printer outputs a full color or monochrome image according to image data output from a personal computer, an image reading device (not shown), or the like, or image data sent through a telephone line, a LAN, or the like.

Figure 4:
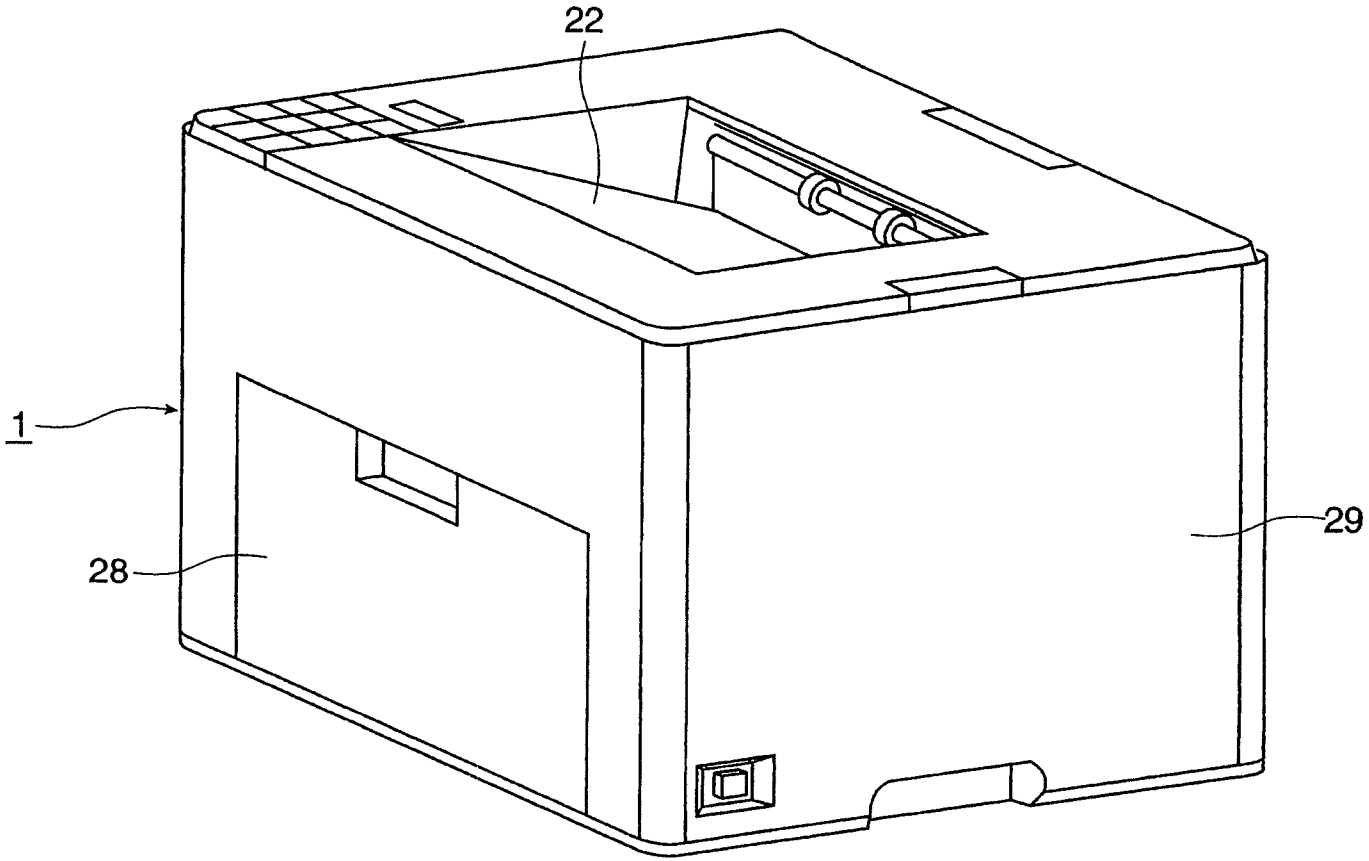
FIG. 4 is a perspective view showing the appearance of the tandem type color printer as the image forming apparatus to which the powder storage container according to the first exemplary embodiment of the invention is applied.
Figure 5:
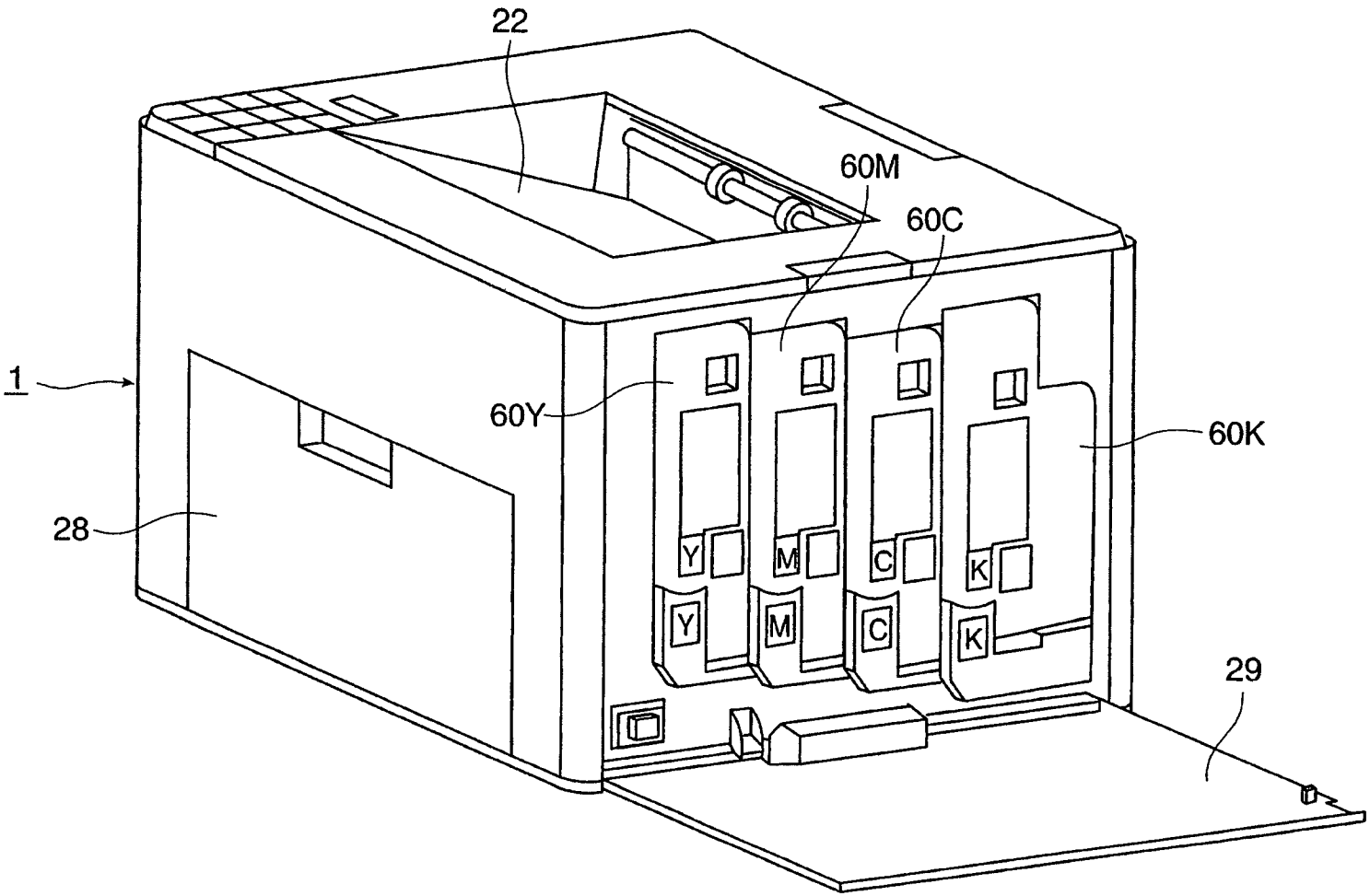
FIG. 5 is a perspective view showing the appearance of the tandem type color printer as the image forming apparatus to which the powder storage container according to the first exemplary embodiment of the invention is applied and of which a cover is opened.
Figure 6:
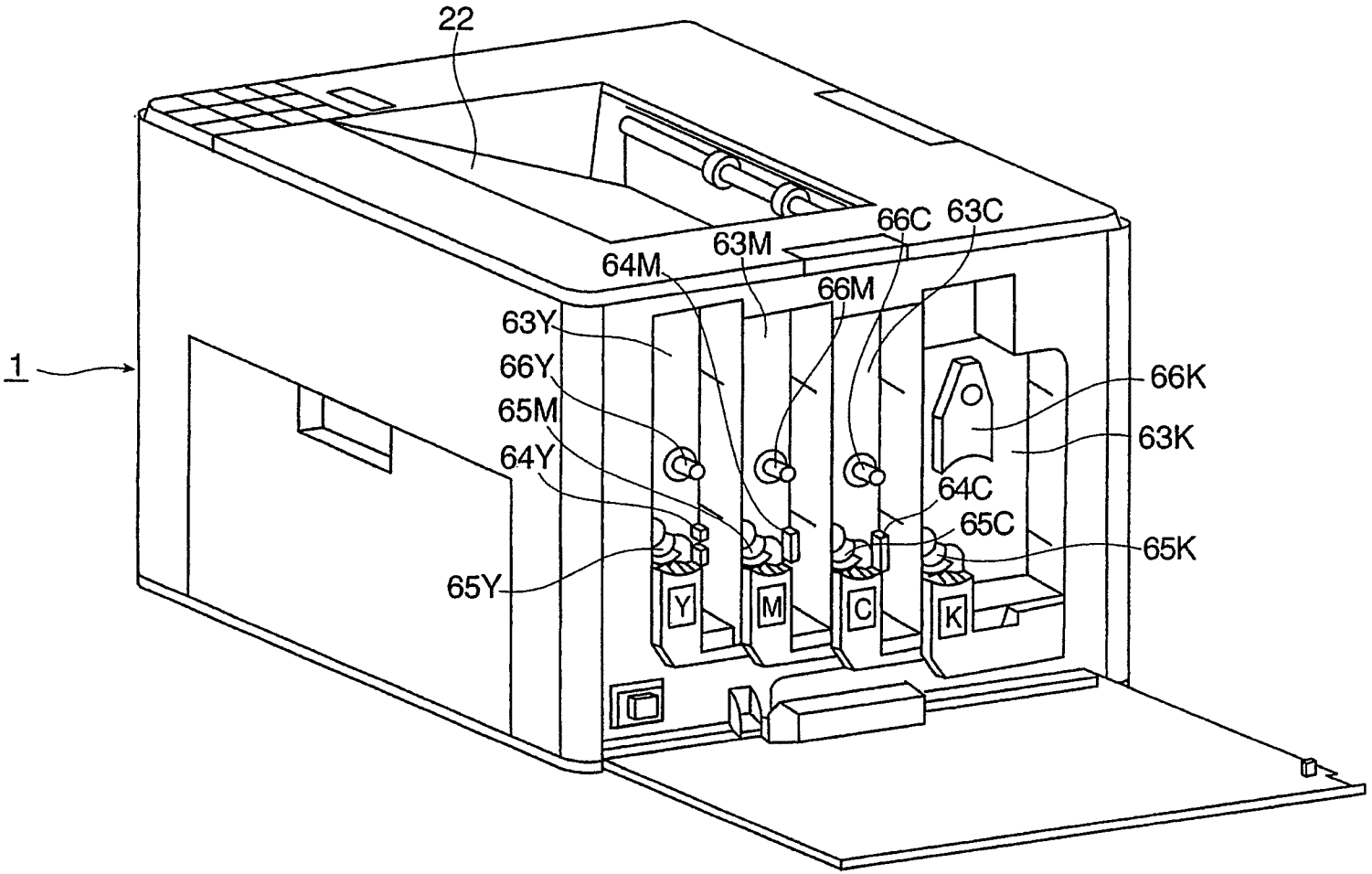
FIG. 6 is a perspective view showing the appearance of the tandem type color printer as the image forming apparatus to which the powder storage container according to the first exemplary embodiment of the invention is applied and of which a cover is opened.

As shown in FIGS. 4 to 6, a main body 1 of the color printer is formed in a substantially rectangular parallelepiped shape. A front cover 28, which is used for the supply of recording sheets, is provided on the front surface of the color printer main body 1 so as to be freely opened and closed. A side cover 29, which is used for the replacement of toner cartridges 60Y, 60M, 60C, and 60K as the powder storage containers, is provided on one side surface of the color printer main body so as to be freely opened and closed. Further, a discharge tray 22, onto which a recording sheet on which an image has been formed is discharged, is integrally formed at an upper portion of the color printer main body 1.

As shown in FIG. 2, an image processing unit 3 and a control unit 4 for controlling the entire color printer are provided in the color printer main body 1. The image processing unit performs predetermined image processing as necessary, such as shading correction, displacement correction, brightness/color space conversion, gamma correction, frame elimination, and color/movement editing, on image data sent from a personal computer (PC) 2, an image reading device (not shown), or the like, as occasion demands.

Further, the image data, which has been subjected to the predetermined image processing in the image processing unit 3 as described above, are converted into image data corresponding to four colors, that is, yellow (Y), magenta (M), cyan (C), and black (K), by the image processing unit 3. Then, as described below, the image data is output as a full color image or a monochrome image by an image output unit 5 provided in the color printer main body 1.

The image data, which is converted into image data corresponding to four colors, that is, yellow (Y), magenta (M), cyan (C), and black (K), by the image processing unit 3, are sent to image exposure devices 7Y, 7M, 7C, and 7K of image forming units 6Y, 6M, 6C, and 6K corresponding to the respective yellow (Y), magenta (M), cyan (C), and black (K). In the image exposure devices 7Y, 7M, 7C, and 7K, image exposure is performed by light emitted from a LED (light-emitting device) array according to corresponding color image data.

As shown in FIG. 2, four image forming units (image forming section) 6Y, 6M, 6C, and 6K corresponding to yellow (Y), magenta (M), cyan (C), and black (K) are disposed in parallel at regular intervals in the color printer main body 1 and are inclined to a horizontal direction by a predetermined angle (for example, about 10°) so that the first color image forming unit 6Y corresponding to yellow (Y) is relatively high and the last color image forming unit 6K corresponding to black (K) is relatively low. Meanwhile, an inclination angle of the image forming units 6Y, 6M, 6C, and 6K is not limited to about 10°, and may be larger or smaller than about 10°.

If the four image forming units 6Y, 6M, 6C, and 6K corresponding to yellow (Y), magenta (M), cyan (C), and black (K) are disposed so as to be inclined by a predetermined angle as described above, it may be possible to set a distance between the image forming units 6Y, 6M, 6C, and 6K to a distance smaller than a distance between the four image forming units 6Y, 6M, 6C, and 6K that are disposed in a horizontal direction. Accordingly, the width of the color printer main body 1 is reduced, so that it may be possible to further reduce the size of the color printer.

These four image forming units 6Y, 6M, 6C, and 6K have basically the same structure except for the color of an image to be formed. As shown in FIGS. 2 and 3, each of the four image forming units broadly includes a photoreceptor drum 8 as an image holding member that is rotationally driven at a predetermined speed in a direction of an arrow A by drive means (not shown), a charging roller 9 for primary charging that uniformly charges the surface of the photoreceptor drum 8 with electricity, an image exposure device 7 that is formed of a LED print head for forming an electrostatic latent image on the surface of the photoreceptor drum 8 by exposing an image corresponding to a predetermined color, a developing device 10 that develops the electrostatic latent image formed on the photoreceptor drum 8 with toner corresponding to a predetermined color, and a cleaning device 11 that cleans the surface of the photoreceptor drum 8.

As the photoreceptor drum 8, there is used, for example, a member that is formed in the shape of a drum having a diameter of about 30 mm and of which the surface is coated with a photoreceptor layer formed of an organic photoconductor (OPC) or the like. The photoreceptor drum is rotationally driven at a predetermined speed in a direction of an arrow A by a drive motor (not shown).

Further, as the charging roller 9, there is used, for example, a roller-like charger of which the surface of a metal core is coated with a conductive layer. The conductive layer is made of a synthetic resin or synthetic rubber, and the electrical resistance of the conductive layer has been adjusted. A predetermined charging bias is applied to the metal core of the charging roller 9.

As shown in FIG. 2, the image exposure device 7 is disposed at each of the four image forming units 6Y, 6M, 6C, and 6K. As the image exposure device 7 provided at each of the image forming units 6Y, 6M, 6C, and 6K, there is used a unit that includes a LED (light-emitting device) array and a rod lens array. The LED array includes LEDs that are linearly disposed in an axial direction of the photoreceptor drum 8 at a predetermined pitch (for example, 600 to 1200 dpi). The rod lens array forms a spot-like image on the photoreceptor drum 8 with light that is emitted from each of the LEDs (light-emitting devices) of the LED (light-emitting device) array. Further, as shown in FIGS. 2 and 3, the image exposure device 7 scans and exposes an image on the photoreceptor drum 8 from below.

Meanwhile, if the unit including the LED array is used as the image exposure device 7, it may be possible to significantly reduce the size of the image exposure device. For this reason, it is preferable that the unit including the LED array be used as the image exposure device 7. The image exposure device 7 is not limited to the unit including the LED array, and a unit for deflecting a laser beam and scanning an image in the axial direction of each of the photoreceptor drums 8 may be used as the image exposure device. In this case, one image exposure device 7 is provided for four image forming units 6Y, 6M, 6C, and 6K.

As described above, corresponding color image data is sequentially output from the image processing unit 3 to the image exposure devices 7Y, 7M, 7C, and 7K that are separately provided at the respective image forming units 6Y, 6M, 6C, and 6K corresponding to yellow (Y), magenta (M), cyan (C), and black (K). The surfaces of the corresponding photoreceptor drums 8Y, 8M, 8C, and 8K are scanned and exposed by luminous flux, which is emitted from the image exposure devices 7Y, 7M, 7C, and 7K according to image data. Accordingly, electrostatic latent images corresponding to the image data are formed. The electrostatic latent images formed on the photoreceptor drums 8Y, 8M, 8C, and 8K are developed as color toner images, which correspond to yellow (Y), magenta (M), cyan (C), and black (K), by the developing devices 10Y, 10M, 10C, and 10K.

The respective color toner images corresponding to yellow (Y), magenta (M), cyan (C), and black (K), which are sequentially formed on the photoreceptor drums 8Y, 8M, 8C, and 8K of the respective image forming units 6Y, 6M, 6C, and 6K, are primarily, sequentially, and multiply transferred to an intermediate transfer belt 12 as an intermediate transfer body, which is disposed above the respective image forming units 6Y, 6M, 6C, and 6K so as to be inclined, by four primary transfer rollers 13Y, 13M, 13C, and 13K.

The intermediate transfer belt 12 is an endless belt-like member that is stretched by a plurality of rollers, and is inclined to a horizontal direction so that a lower side running area of the belt-like member is relatively low on the downstream side in a running direction of the belt-like member and relatively high on the upstream side in the running direction.

That is, as shown in FIG. 2, the intermediate transfer belt 12 is stretched and rotated between a driving roller 15 and a driven roller 14, which function as support rollers for supporting the back surface of a secondary transfer portion, with a predetermined tension. The intermediate transfer belt 12 is circularly driven at a predetermined speed in a direction of an arrow B by the driving roller 15 that is rotationally driven by a drive motor (not shown) having an excellent constant speed property. As the intermediate transfer belt 12, there is used, for example, a member that is formed of a synthetic resin film made of polyimide, polyamide-imide, or the like, having flexibility in the shape of an endless belt. The intermediate transfer belt 12 is disposed so as to come into contact with the photoreceptor drums 8Y, 8M, 8C, and 8K of the respective image forming units 6Y, 6M, 6C, and 6K in the lower side running area.

Further, as shown in FIG. 2, a secondary transfer roller 17 as secondary transfer means is disposed at a lower end of the running area of the intermediate transfer belt 12 so as to come into contact with the surface of the intermediate transfer belt 12 that is stretched by the driving roller 15. The secondary transfer means secondarily transfers the toner images, which have been primarily transferred to the intermediate transfer belt 12, to a recording medium 16.

The respective color toner images corresponding to yellow (Y), magenta (M), cyan (C), and black (K), which have been multiply transferred to the intermediate transfer belt 12, are secondarily transferred to the recording sheet 16 as a recording medium by the secondary transfer roller 17, which comes into contact with the driving roller 15 with the intermediate transfer belt 12 interposed therebetween, as shown in FIG. 2. The recording sheet 16 to which the respective color toner images have been transferred is conveyed to a fixing device 18 that is positioned on the upper side in a vertical direction. The secondary transfer roller 17 comes into press contact with the driving roller 15 in a lateral direction with the intermediate transfer belt 12 interposed therebetween, and secondarily and collectively transfers the respective color toner images to the recording sheet 16 that is conveyed from the lower side to the upper side in the vertical direction.

As the secondary transfer roller 17, there is used, for example, a member that is formed by coating the outer periphery of a metal core with an elastic layer with a predetermined thickness. The metal core is made of metal such as stainless steel, and the elastic layer is formed of a conductive elastic body made of a synthetic rubber material or the like to which a conductive agent is added.

Further, the recording sheet 16 to which the respective color toner images have been transferred is subjected to fixing processing by heat and pressure, which are applied by a heating roller 19 and a pressure belt (or a pressure roller) 20 of the fixing device 18. Then, the recording sheet is discharged onto the discharge tray 22, which is provided at an upper end portion of the printer main body 1, by a discharge roller 21 so that the surface of the recording sheet on which the images are formed faces the lower side.

While being separated one by one by a sheet feed roller 24 and a sheet separation roller 25, the recording sheets 16, which have a predetermined size and are made of a predetermined material, are fed from a sheet feed tray 23 disposed at the bottom in the printer main body 1 as shown in FIG. 2, are conveyed to a registration roller 26 once, and are stopped. Further, the recording sheet 16, which is fed from the sheet feed tray 23, is sent to a secondary transfer position of the intermediate transfer belt 12 by the registration roller 26 that is rotationally driven in synchronization with the toner images formed on the intermediate transfer belt 12. A thick sheet or the like, such as coated paper of which one surface or both surfaces are coated, may be fed as the recording sheet 16, in addition to plain paper. A photo image or the like is also output on the recording sheet 16 formed of coated paper.

Meanwhile, as shown in FIGS. 2 and 3, residual toner is removed from the surface of the photoreceptor drum 8, on which a primary transfer process for the toner image has been finished, by the cleaning device 11, and the surface of the photoreceptor drum 8 prepares for the next image forming process. Further, as shown in FIG. 2, residual toner or the like is removed from the surface of the intermediate transfer belt 12, on which a secondary transfer process for the toner image has been finished, by a belt cleaning device 27 that is provided near the downstream side of the driving roller 15, and the surface of the intermediate transfer belt 12 prepares for the next image forming process.

Figure 7:
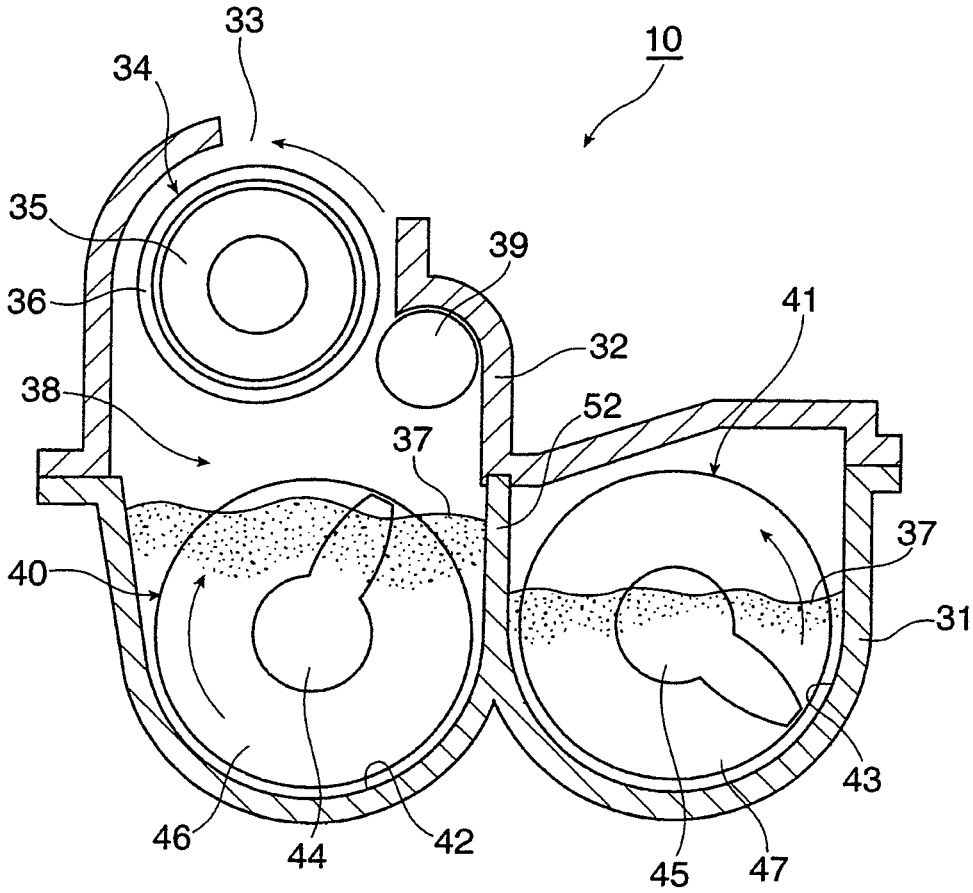
FIG. 7 is a cross-sectional view of a developing device.

FIG. 7 is a view showing the structure of the developing device that is used in the color printer as the image forming apparatus according to the first exemplary embodiment of the invention.

As shown in FIG. 7, the developing device 10 includes lower and upper housings 31 and 32, an opening 33 is formed at an upper end portion of one side of the upper housing 32, and a developing roller 34 as a powder holding body is disposed at the opening 33. The developing roller 34 includes a magnet roller 35 that is fixed in the developing roller, and a developing sleeve 36 that is provided on the outer periphery of the magnet roller 35 so as to be rotatable in a direction of an arrow.

Further, a powder storage chamber 38 as a space, which stores two-component powder 37 formed of, for example, toner and carrier and is formed by the upper housing 32 combined with the lower housing 31, is formed below the developing roller 34. A powder regulating member 39, which regulates the amount of powder 37 to be supplied to the surface of the developing roller 34, is disposed in the upper housing 32 near the opening 33 on the downstream side in a rotational direction of the developing roller 34 so that a predetermined gap is formed between the powder regulating member and the surface of the developing roller 34. The powder regulating member 39 is formed so as to regulate the amount of powder 37, which is supplied to the surface of the developing roller 34, by, for example, magnetism. The powder regulating member is made of, for example, a magnetic material such as nickel, and is formed in the shape of a column having a predetermined diameter.

Meanwhile, the two-component powder 37 formed of toner and carrier is stored in the lower housing 31. A first agitating-conveying auger 40 as a first powder agitating-conveying member, which supplies the powder 37 to the surface of the developing roller 34 by conveying the powder 37 while agitating the powder 37, and a second agitating-conveying auger 41 as a second powder agitating-conveying member, which conveys the powder 37 while agitating the powder, are disposed in the lower housing. The powder storage chamber 38, which is formed in the lower housing 31, is partitioned into a first agitating-conveying auger receiving chamber 42 as a first powder agitating-conveying member receiving chamber that receives the first agitating-conveying auger 40, and a second agitating-conveying auger receiving chamber 43 as a second powder agitating-conveying member receiving chamber that receives the second agitating-conveying auger 41, by a partition plate 52.

Figure 8:
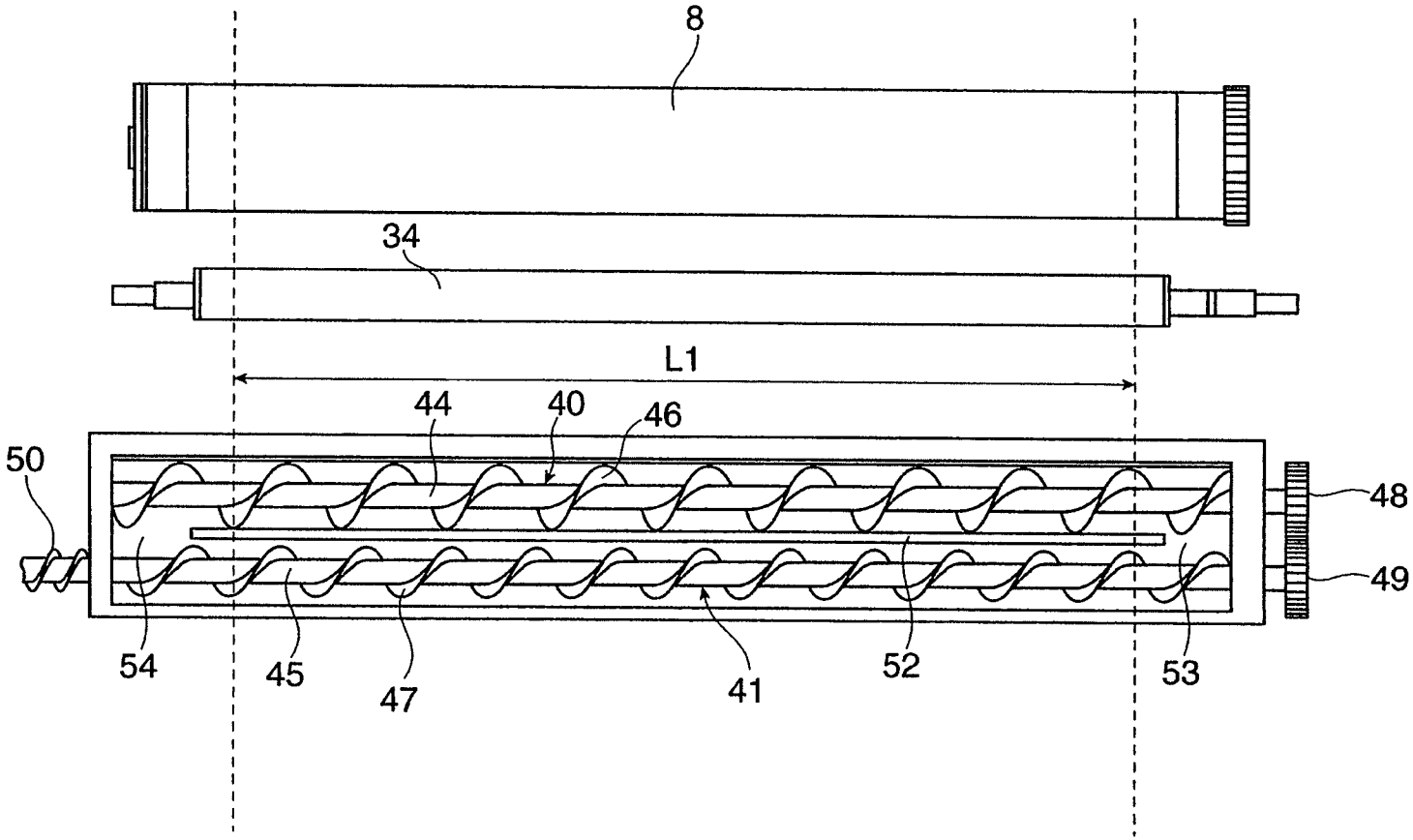
FIG. 8 is a developed plan view of the developing device.

Further, as shown in FIG. 8, the first and second agitating-conveying augers 40 and 41 include rotating shafts 44 and 45 that are formed in a columnar shape, and agitating-conveying blades 46 and 47 that are formed in a spiral shape on the outer peripheries of the rotating shafts 44 and 45, respectively. The first and second agitating-conveying augers are formed to convey the powder 37 while agitating the powder 37 in directions opposite to each other.

As shown in FIG. 8, the first and second agitating-conveying augers 40 and 41 are rotationally driven by gears 48 and 49 that are fixed to one ends of the rotating shafts 44 and 45 thereof.

Figure 9:
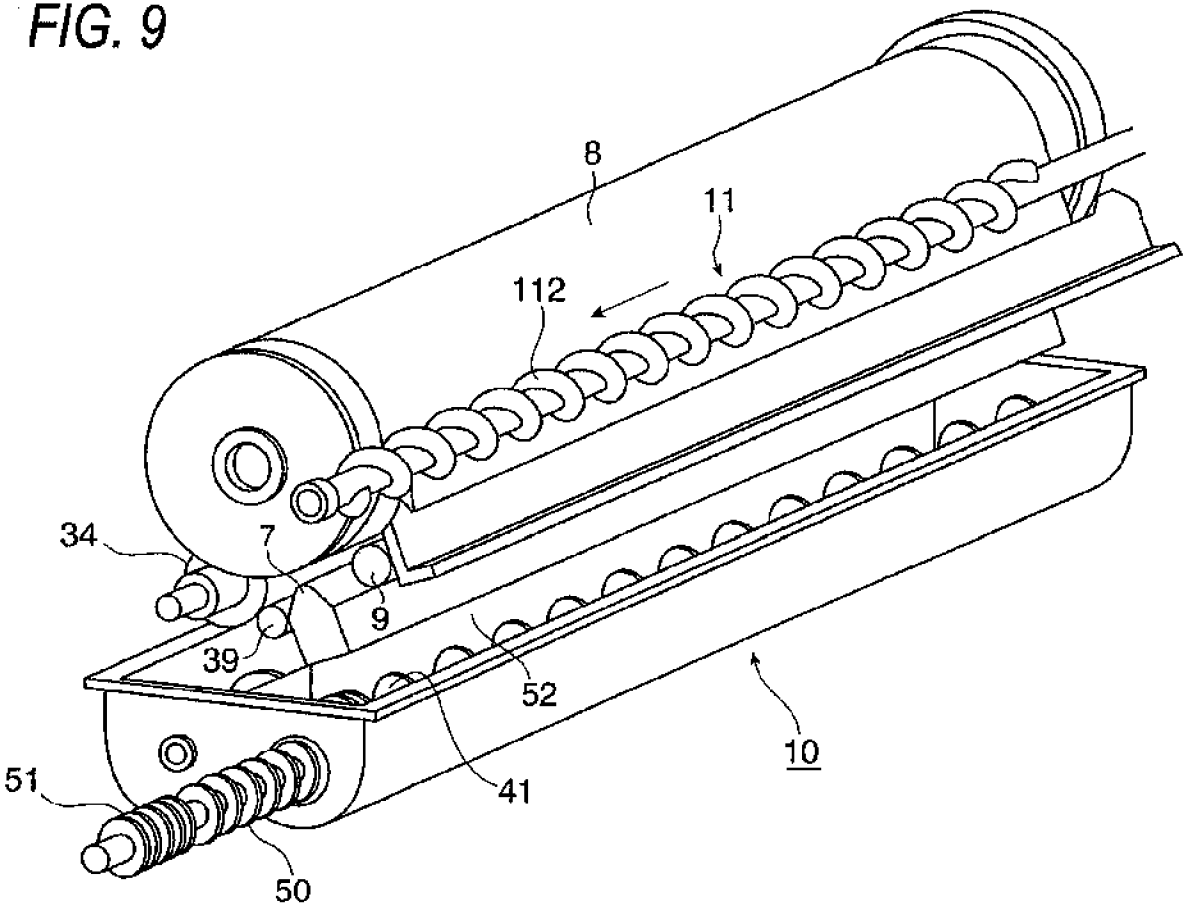
FIG. 9 is a perspective view of the image forming unit.

New powder 37 including at least toner is supplied to the developing device 10 from a toner cartridge to be described below, by a powder supply auger 50 that extends from one end (front portion in FIG. 9) of the second agitating-conveying auger 41 in the axial direction of the second agitating-conveying auger as shown in FIG. 9. As occasion demands, a leakage preventing blade 51, which prevents the powder 37 from leaking, may be formed integrally with an end portion of the powder supply auger 50.

Furthermore, as shown in FIG. 9, the cleaning device 11 for cleaning the surface of the photoreceptor drum 8 includes a cleaning blade 111 that comes into contact with the surface of the photoreceptor drum 8, and a recovery auger 112. The recovery auger recovers toner, which is removed from the surface of the photoreceptor drum 8, by the cleaning blade 111. A waste toner conveying member 113, which is formed in a cylindrical shape, is formed on the outer periphery of the recovery auger 112. As shown in FIG. 6, the end of the waste toner conveying member 113 protrudes on the side surface of the printer main body 1.

Moreover, as shown in FIG. 8, the partition plate 52, which partitions the powder storage chamber into the first agitating-conveying auger receiving chamber 42 and the second agitating-conveying auger receiving chamber 43, is provided in the developing device 10, and circulation passages 53 and 54, which circulate the powder by exchanging the powder 37 between the first agitating-conveying auger receiving chamber 42 and the second agitating-conveying auger receiving chamber 43, are formed at both ends of the partition plate 52 in a longitudinal direction of the partition plate.

Meanwhile, new powder 37 may be supplied to the developing device 10 so that powder 37 is dropped to the circulation passage 54 or the end of the second agitating-conveying auger 41 by the powder supply auger 51.

In this exemplary embodiment, as shown in FIG. 5, the toner cartridges 60Y, 60M, 60C, and 60K as the powder storage containers, which store powder 61 including at least color toner corresponding to yellow (Y), magenta (M), cyan (C), and black (K), are mounted on the side surface of the color printer, which is exposed to the outside when the side cover 29 of the color printer main body 1 is opened. Powder 61 including at least toner is supplied to the developing devices 10Y, 10M, 10C, and 10K, which correspond to the colors, from the toner cartridges 60Y, 60M, 60C, and 60K. In this exemplary embodiment, only toner 61 is stored in the toner cartridges 60Y, 60M, 60C, and 60K as powder. However, powder formed of toner and carrier may be stored in the toner cartridges. The toner cartridges 60Y, 60M, 60C, and 60K have basically the same shape, but the toner cartridge 60K corresponding to black (K) is formed to be larger than the toner cartridge 60Y, 60M, and 60C corresponding to the other colors.

As shown in FIG. 6, a cartridge receiving frame 62, on which the color toner cartridges 60Y, 60M, 60C, and 60K corresponding to yellow (Y), magenta (M), cyan (C), and black (K) are detachably mounted, is provided on one side surface of the color printer main body 1. Four mounting recesses 63Y, 63M, 63C, and 63K corresponding to the shapes of the respective toner cartridges 60Y, 60M, 60C, and 60K are formed at the cartridge receiving frame 62 so that the color toner cartridges 60Y, 60M, 60C, and 60K corresponding to a yellow color, a magenta color, a cyan color, and a black color are mounted on the cartridge receiving frame. In order to prevent the other color toner cartridges from being mounted erroneously, erroneous mounting prevention protrusions 64Y, 64M, and 64C having different shapes are formed at the mounting recesses 63Y, 63M, and 63C, where the color toner cartridges 60Y, 60M, and 60C are mounted, among the four mounting recesses 63Y, 63M, 63C, and 63K.

In the mounting recesses 63Y, 63M, 63C, and 63K, powder supply portions 65Y, 65M, 65C, and 65K for supplying color powder corresponding to yellow (Y), magenta (M), cyan (C), and black (K) are provided and powder recovery portions 66Y, 66M, 66C, and 66K for recovering waste toner from the cleaning devices 11Y, 11M, 11C, and 11K corresponding to yellow (Y), magenta (M), cyan (C), and black (K) are provided. Among the recovery portions 66Y, 66M, 66C, and 66K, the powder recovery portion 66K corresponding to black (K) is larger than the other recovery portions 66Y, 66M, and 66C so as to recover waste toner from the cleaning device 11K for the photoreceptor drum 8K and also recover waste toner from the belt cleaning device 27 for the intermediate transfer belt 12.

Meanwhile, as shown in FIG. 6, the powder supply portions 65Y, 65M, 65C, and 65K include cylindrical powder receiving portions 67 where powder supplying cylindrical portions formed at the toner cartridges 60Y, 60M, 60C, and 60K are mounted, and introducing portions 68 which are formed in a semi-cylindrical shape and of which upper portions are opened on the front side of the powder receiving portions 66.

Further, as shown in FIG. 6, the powder recovery portions 66Y, 66M, 66C, and 66K are formed of end portions of the waste toner conveying members 113 that protrude from the inner surfaces of the mounting recesses 63Y, 63M, 63C, and 63K on the front side of the cleaning devices 11 of the image forming units 6Y, 6M, 6C, and 6K, and waste toner outlets (not shown) are opened downward on the lower end faces of the end portions of the powder recovery portions 66Y, 66M, 66C, and 66K.

Figure 10:
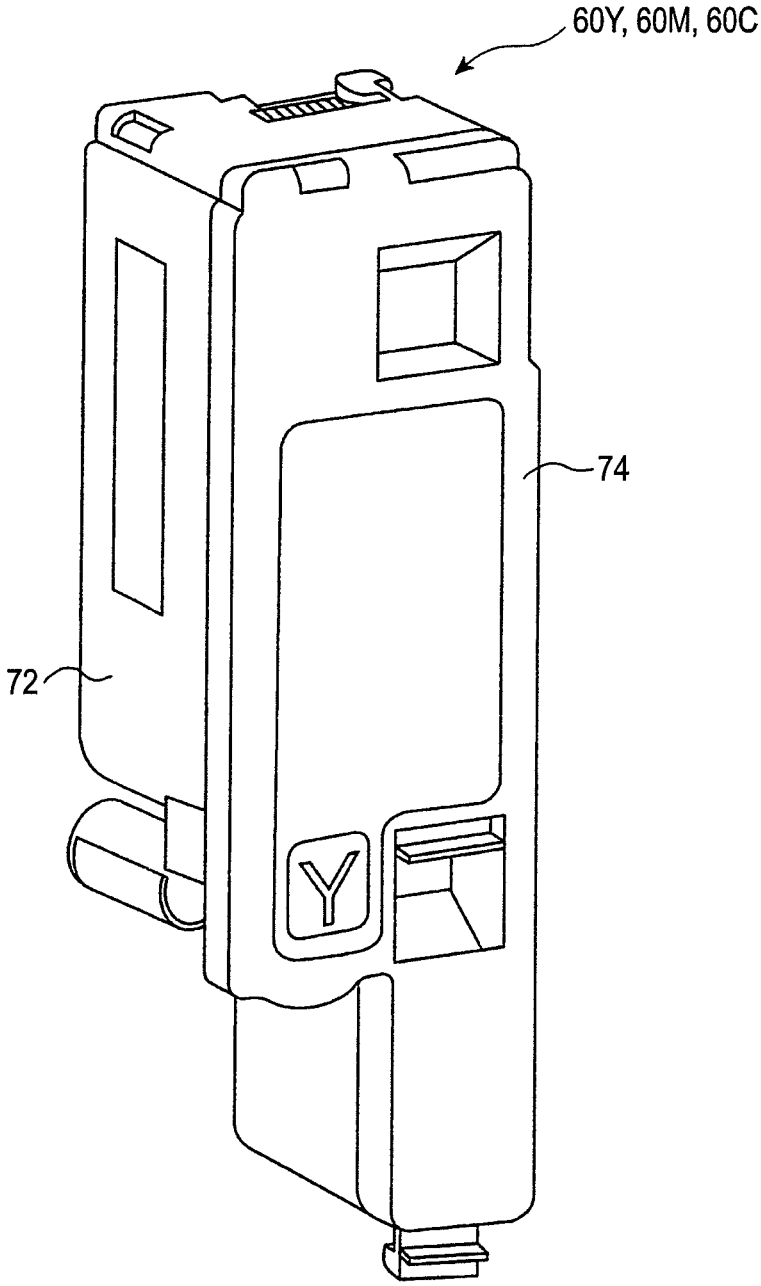
FIG. 10 is a perspective view showing the appearance of the toner cartridge as the powder storage container according to the first exemplary embodiment of the invention.

Meanwhile, among the toner cartridges 60Y, 60M, 60C, and 60K as the powder storage containers according to this exemplary embodiment, the color toner cartridges 60Y, 60M, and 60C corresponding to yellow (Y), magenta (M), and cyan (C) are formed in the shape of a substantially rectangular parallelepiped box that is elongated in a vertical direction as shown in FIG. 10. Further, as shown in FIG. 5, the toner cartridge 60K corresponding to black (K) is formed to have a width larger than the width of each of the color toner cartridges 60Y, 60M, and 60C.

Figure 11:
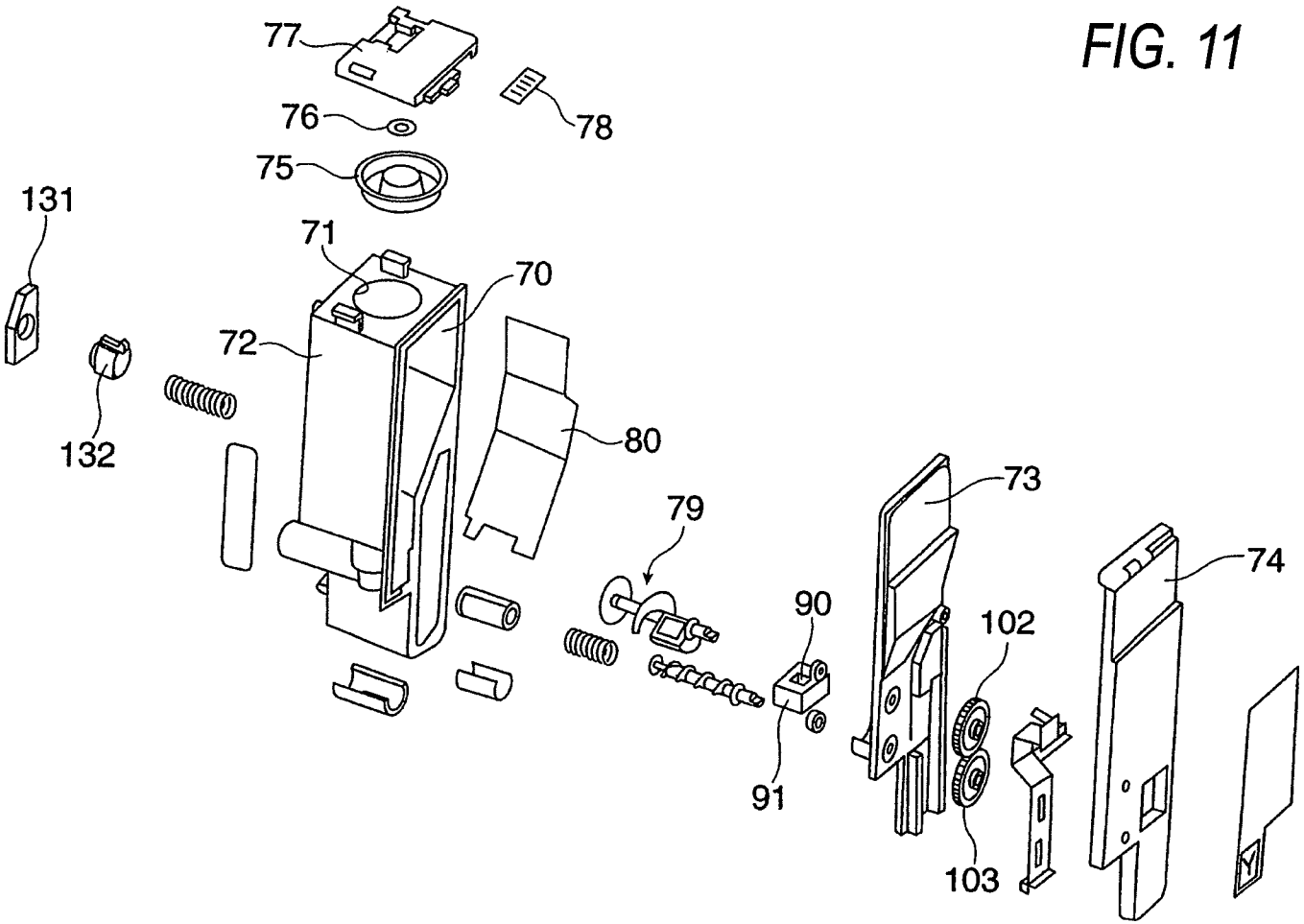
FIG. 11 is an exploded perspective view of the toner cartridge as the powder storage container according to the first exemplary embodiment of the invention.

As shown in FIG. 11, the toner cartridge 60 broadly includes a container body 72, an inner lid body 73, an outer lid body 74, a cap member 75, a sealing member 76, an upper lid 77, a memory element 78, a conveying auger 79, and a plate-like elastic member 80. One side surface 70 of the container body is wholly opened, and a toner filling opening 71 is formed at an upper end portion of the container body. The container body 72 is formed in the shape of a substantially rectangular parallelepiped box that is elongated in the vertical direction. The inner lid body 73 is provided so as to close one surface of the container body 72. The outer lid body 74 is provided on the surface of the inner lid body 73. The cap member 75 closes the toner filling opening 71 of the container body 72, and the sealing member 76 seals an air hole. The upper lid 77 is mounted on the upper end portion of the container body 72. The memory element 78 is mounted in the upper lid 77, stores data relating to the toner cartridge 60, and can be read from the outside. The conveying auger 79 serves as an agitating-conveying member for conveying the powder 61, which is stored in the container body 72, to an outlet while agitating the powder. The plate-like elastic member 80 is disposed in the container body 72.

Figure 1:
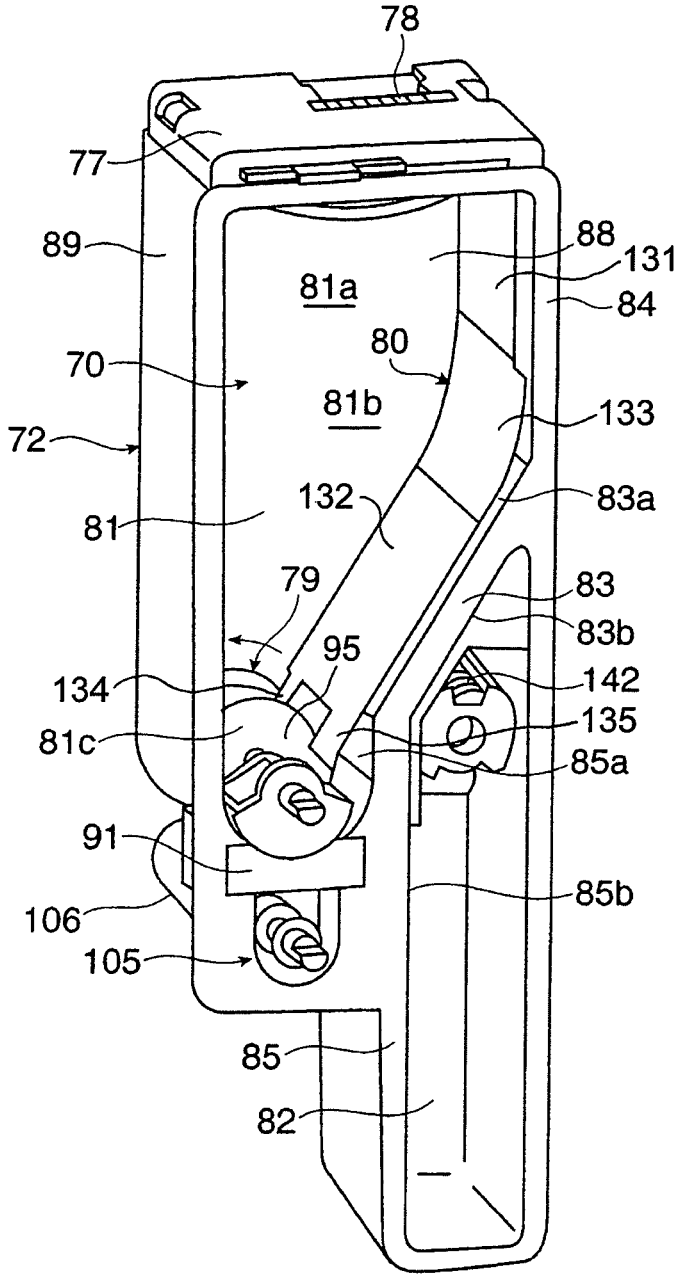
FIG. 1 is a perspective view showing main parts of a toner cartridge as a powder storage container according to a first exemplary embodiment of the invention.

As shown in FIG. 1, the container body 72 of the toner cartridge 60 is formed of a substantially rectangular parallelepiped box that is elongated in the vertical direction and includes an opening 70 formed on the whole of one surface (front surface). The inner space of the container body 72 is partitioned into a new powder storage chamber 81 that stores new powder, and a waste powder storage chamber 82 that recovers waste powder, by a partition wall 83 that is disposed so as to be inclined from a middle portion of one side wall 84 of the container body 72 toward the other side wall 89. The partition wall 83 is formed to have double structure that includes a partition wall 83*a* of the new powder storage chamber 81 and a partition wall 83*b* of the waste powder storage chamber 82. The partition wall 83*a* is disposed so that an upper end portion of the partition wall 83*a* is connected to a lower end portion of one side wall 84 forming the new powder storage chamber 81. The partition wall 83*a* is disposed so as to be inclined toward the lower left side in FIG. 1. A lower end portion of the partition wall 83*a* is connected to an upper end portion of the side wall 85 that is disposed so as to face the side wall 84 of the new powder storage chamber 81 and forms the waste powder storage chamber 82. Like the partition wall 83, the side wall 85 is also formed to have double structure that includes a side wall 85*a* of the new powder storage chamber 81 and a side wall 85*b* of the waste powder storage chamber 82.

Meanwhile, in the shown exemplary embodiment, the new powder storage chamber 81 has been set to occupy about ¾ to ⅔ of the entire length of the toner cartridge 60 and the waste powder storage chamber 82 has been set to occupy about ¼ to ⅓ thereof. However, it goes without saying that a ratio of the volume of the new powder storage chamber 81 to the volume of the waste powder storage chamber 82 may be set to another ratio. Further, all the inner space of the toner cartridge 60 may form the new powder storage chamber 81 without forming the waste powder storage chamber 82.

As shown in FIG. 11, the new powder storage chamber 81 and the waste powder storage chamber 82 of the toner cartridge 60 are closed by the inner lid body 73 that closes the opening 70 of the container body 72, and the inner space of the container body is partitioned into the new powder storage chamber 81 and the waste powder storage chamber 82. As shown in FIG. 1, the inner lid body 73 is mounted and fixed to wall members, which include the side wall 84 and the partition wall 83 formed at the inner and outer peripheries of the opening 70, by means such as ultrasonic welding so as to close the entire area of the opening 70 of the container body 72. In this case, the back sides of the partition wall 83 and the side wall 85, which are positioned between the new powder storage chamber 81 and the waste powder storage chamber 82, are separated from each other by the separation groove 86 as shown in FIG. 12 so that a welding part of an ultrasonic welding device can also be inserted into the back side of the partition wall 83 for partitioning the new powder storage chamber 81 and the waste powder storage chamber 82.

Figure 12:
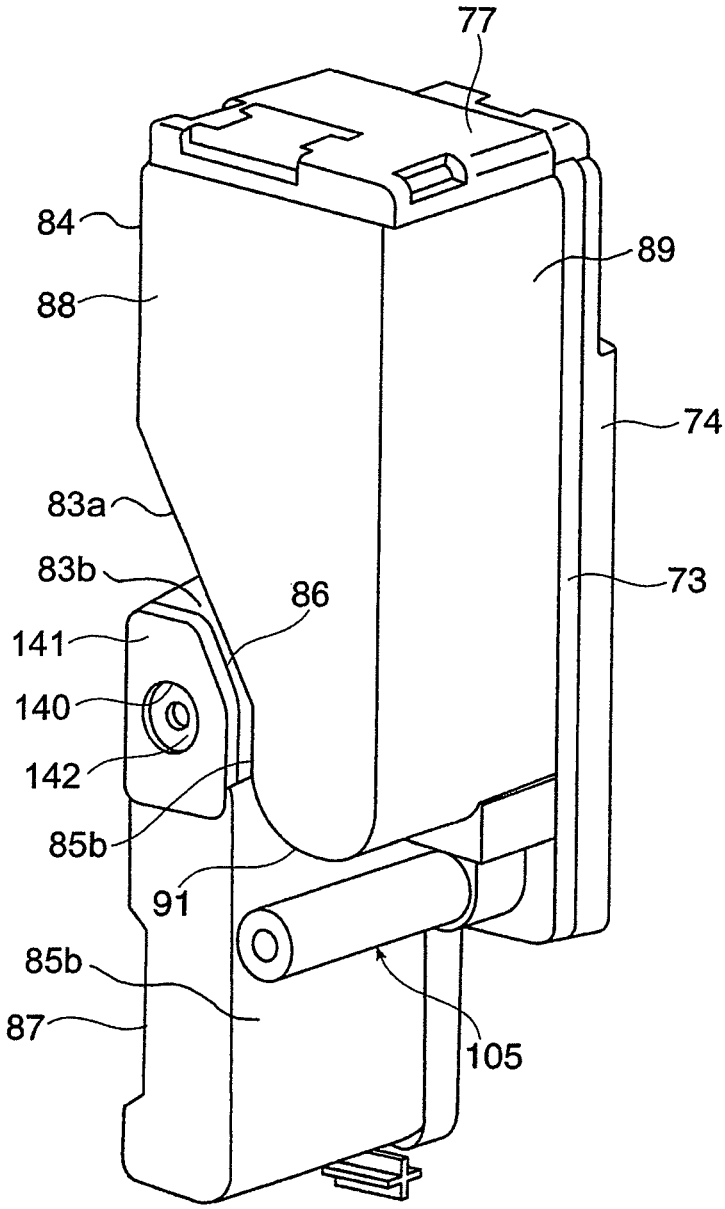
FIG. 12 is a perspective view showing the back surface of the toner cartridge as the powder storage container according to the first exemplary embodiment of the invention.

Meanwhile, reference numeral 87 in FIG. 12 denotes a recess that has the shape corresponding to each of the erroneous mounting prevention protrusions 64Y, 64M, and 64C of the color toner cartridges 60Y, 60M, and 60C.

As shown in FIG. 1, four side walls 84, 88, 89, and 73, which include the inner lid body 73, for closing the opening 70, are disposed in the vertical direction from the upper end portion of the new powder storage chamber 81 over the lower end portion. Further, the side wall 84 is formed from the upper end portion of the new powder storage chamber 81 over the middle portion thereof, and the inclined partition wall 83*a* is connected to the lower end portion of the side wall 84. The lower end portion of the partition wall 83*a* is positioned in the middle of the new powder storage chamber 81 in a width direction of the powder storage chamber. The short side wall 85*a*, which is disposed so as to face the side wall 89, is formed at the lower end portion of the partition wall 83*a*. Furthermore, a bottom wall 91, which is formed in a substantial arc shape, is formed at the lower end portions of the side wall 89 and the side wall 85*a* as shown in FIG. 12.

As a result, as shown in FIG. 1, the new powder storage chamber 81 is formed of an upper end portion 81*a*, an intermediate portion 81*b*, and a lower end portion 81*c*. The upper end portion 81*a* is formed by the four side walls 84, 88, 89, and 73 so as to have substantially the same width as the entire width of the container body 72. The intermediate portion 81*b* is formed so that the width of the intermediate portion is decreased toward one side wall 89. The lower end portion 81*c* is formed by the side wall 89, the side wall 85*a*, and the bottom wall 91 so as to have a substantially U-shaped cross-section.

As shown in FIG. 1, the conveying auger 79 as an agitating-conveying member is provided at the lower end portion 81*c* of the new powder storage chamber 81 so as to be rotated in a direction of an arrow. The conveying auger 79 conveys the powder 61, which is stored in the new powder storage chamber 81, while agitating the powder, and supplies the powder 61 to the outside from an outlet 90, which is formed at the bottom of the lower end portion 81*c* on the front side (the side of the opening 70) in a depth direction of the lower end portion.

Figure 13:
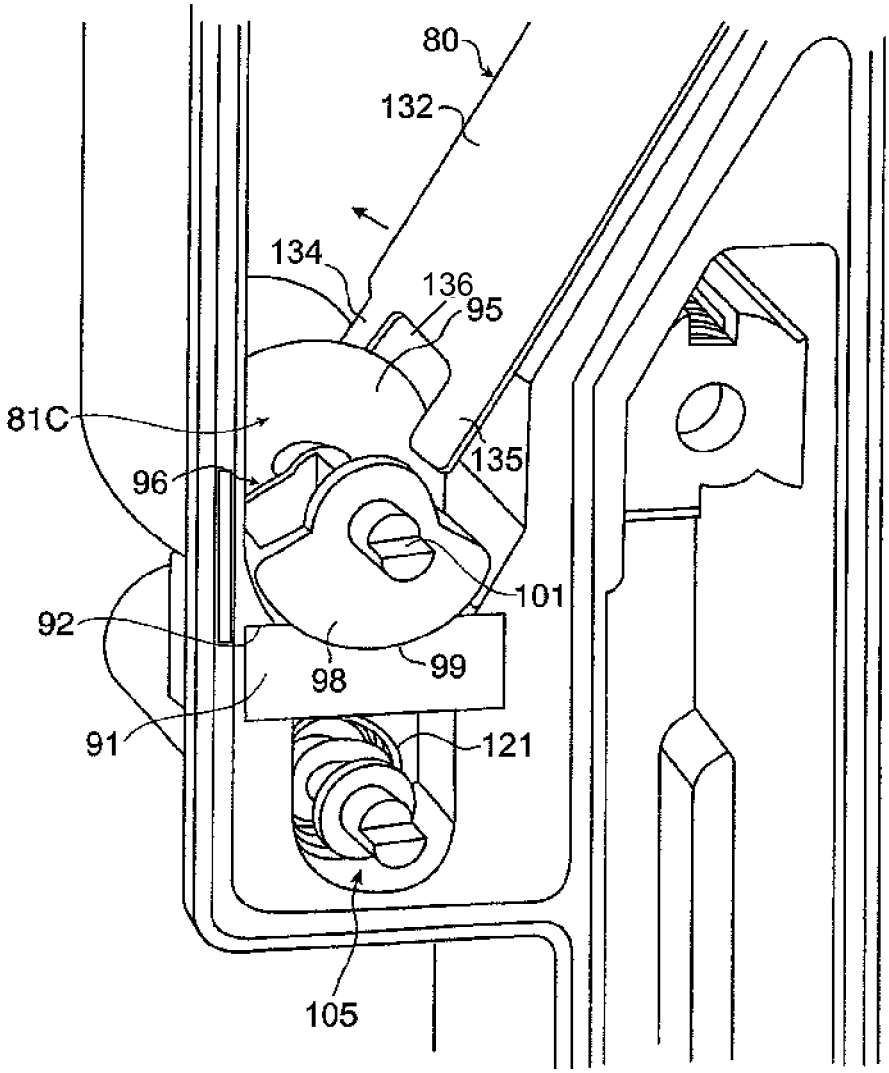
FIG. 13 is a perspective view showing main parts of the toner cartridge.

The outlet 90, which is formed at the bottom of the lower end portion 81*c* of the new powder storage chamber 81, is formed at an outlet forming member 91, which is made of sponge formed in a rectangular parallelepiped shape, so as to be opened in a rectangular shape as shown in FIGS. 1 and 11. As shown in FIG. 13, the outlet forming member 91 is mounted so as to be fitted to a recess 92, which is formed at a position corresponding to the lower end portion 81*c* of the new powder storage chamber 81 of the container body 72. An upper end face of the outlet forming member 91 is deformed in the shape corresponding to the shape of the outer periphery of the conveying auger 79 at the time of the shipment of the toner cartridge 60, and prevents the leakage of the powder 61. Meanwhile, a new toner cartridge 60 is mounted on the printer main body 1 as shown in FIG. 5 at the time of the shipment of a color printer.

Figure 14A:
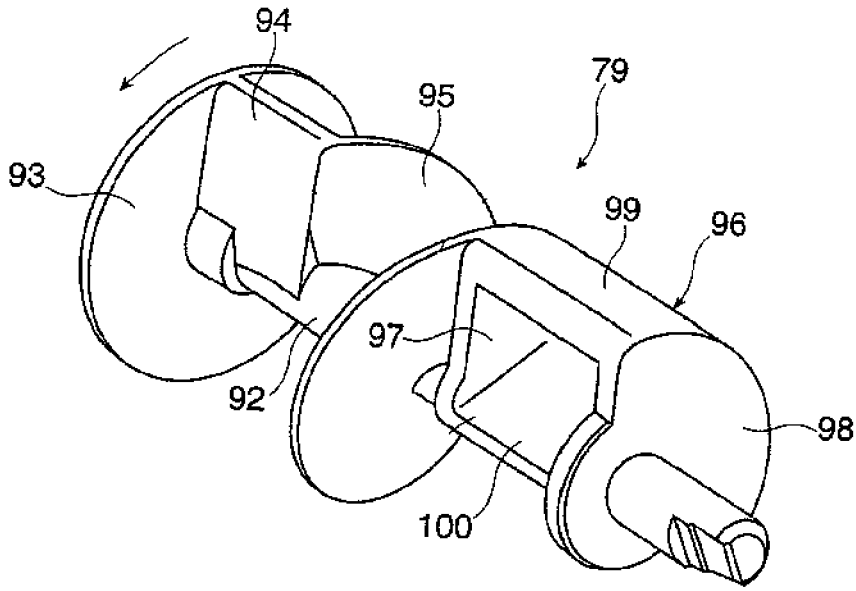
FIGS. 14A and 14B are perspective views of two conveying members.

The conveying auger 79 is integrally made of a synthetic resin or the like as shown in FIG. 14A. The conveying auger includes a rotating shaft 92 that is provided at the center of the conveying auger in a conveying direction, a disc-shaped support portion 93 that is formed at an upstream end portion of the rotating shaft 92 in the conveying direction, a flat plate portion 94 that protrudes outwards from an upstream portion of the rotating shaft 92 in a radial direction in the shape of a flat plate so as to have the same radius as the radius of the disc-shaped support portion 93 and also functions as a first operating portion, a conveying blade portion 95 that is formed in a spiral shape on the outer periphery of only an intermediate portion of the rotating shaft 92, and a discharge portion 96 that is positioned at the rotating shaft 92 on the downstream side in the conveying direction and also functions as a bucket-like second operating portion for discharging powder into the outlet 90.

As shown in FIG. 14A, the discharge portion 96 is formed substantially in the shape of a bucket, and includes a pair of fan-like side plates 97 and 98, an outer peripheral plate 99, and a partition plate 100. The pair of fan-like side plates 97 and 98 is formed at a downstream end portion of the rotating shaft 92 in the conveying direction with a predetermined distance therebetween in the axial direction. The outer peripheral plate 99 is formed in an arc shape so as to cover the outer peripheral surfaces of the pair of fan-like side plates 97 and 98. The partition plate 100 is formed inside the discharge portion 96 at the middle portion in the circumferential direction of the side plates 97 and 98 so as to extend in the radial direction. When the outer peripheral plate 99 closes the outlet 90 as shown in FIG. 13, the discharge portion 96 prevents the leakage of the powder 61.

The discharge portion 96 supplies new powder by scooping new powder 61, which is conveyed in the axial direction of the rotating shaft 92 by the conveying blade portion 95 of the conveying auger 79, into the discharge portion 96 that is formed substantially in the shape of a bucket and dropping the new powder into the outlet 90, which is positioned on the lower side, from the discharge portion 96 that is moved up as the rotating shaft 92 is rotated.

Figure 14B:
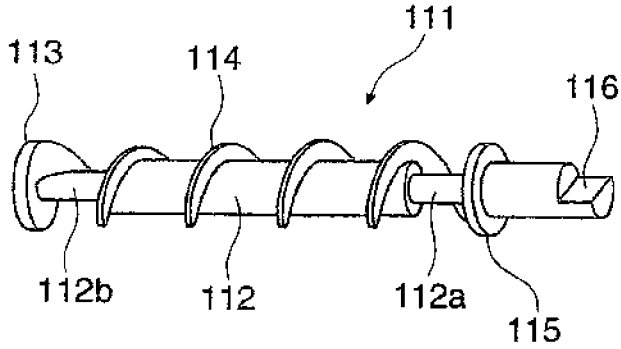
Figure 15:
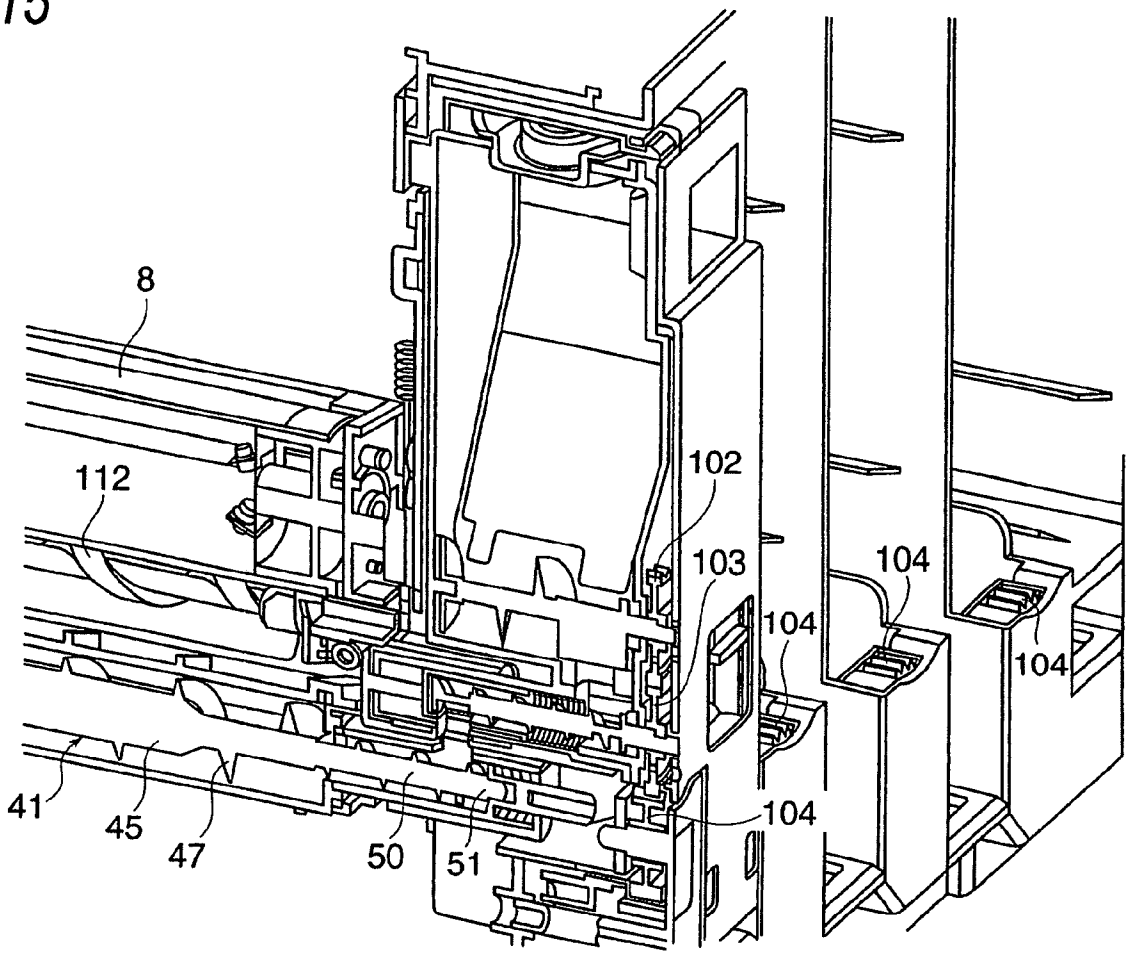
FIG. 15 is a cross-sectional perspective view showing a supply passage where powder is supplied from the toner cartridge.

Further, an end portion 101 of the rotating shaft 92 is formed so as to have a substantially D-shaped cross-section as shown in FIG. 14, and a first driving gear 102 for rotationally driving the conveying auger 79 is fixed to the end portion 101 as shown in FIG. 15. A second driving gear 103 meshes with the driving gear 102 as shown in FIG. 15, and a main body gear 104 mounted on the printer main body 1 meshes with the second driving gear 103.

Furthermore, while the toner cartridges 60Y, 60M, 60C, and 60K are mounted on the printer main body 1 as shown in FIG. 5, a rotational driving force is transmitted to the first driving gears 102 from the main body gears 104, which are rotationally driven at predetermined timing, through the second driving gears 103 as shown in FIG. 15, so that the conveying augers 79 are rotationally driven at predetermined timing.

Moreover, as shown in FIG. 15, each of the toner cartridges 60Y, 60M, 60C, and 60K is integrally provided with powder supply means 105. The powder supply means does not immediately supply new powder 61, which is supplied from the toner cartridges 60Y, 60M, 60C, and 60K, to the developing device 10 from the outlet 90, and supplies powder 61, which is supplied from the new powder storage chamber 81, to the developing device 10. As shown in FIG. 1, the powder supply means 105 includes cylindrical powder supplying members 106 that are integrally formed below the new powder storage chambers 81 of the toner cartridges 60Y, 60M, 60C, and 60K.

As shown in FIG. 15, the powder supplying member 106 is disposed parallel to the conveying auger 79 and an inlet 107 through which powder supplied from the outlet 91 is introduced is formed at one end portion of the powder supplying member. When the outer peripheral plate 99, which is formed in an arc shape, of the discharge portion 96, which is formed substantially in the shape of a bucket, of the conveying auger 79 closes the outlet 91, the inlet 107 is simultaneously closed.

Further, as shown in FIG. 15, a supply port 108 where powder is supplied is opened downward at the other end portion of the powder supplying member 106. The supply port 108 is opened at a position corresponding to a receiving port 110 opened at an upper end portion of a powder supplying cylindrical portion 109 that covers the outer periphery of the powder supply auger 50 of the developing device 10.

Furthermore, a supply auger 111, which supplies powder, is rotatably disposed in the powder supplying member 106 as shown in FIG. 15. The supply auger 111 is integrally made of a synthetic resin or the like as shown in FIG. 14B. The supply auger includes a rotating shaft 112 that is provided at the center of the supply auger in a conveying direction, a disc-shaped support portion 113 that is formed at a downstream end portion of the rotating shaft 112 in the conveying direction, a conveying blade portion 114 that is formed in a spiral shape on the outer periphery of the rotating shaft 112, and a disc-shaped sealing portion 115 that is formed at the rotating shaft 112 on the upstream side in the conveying direction.

Moreover, a base end portion 116 of the rotating shaft 112 is formed so as to have a substantially D-shaped cross-section as shown in FIG. 14B, and a second driving gear 103 for rotationally driving the supply auger 111 is fixed to the base end portion 116 as shown in FIG. 15. As described above, the main body gear 104 mounted on the printer main body 1 meshes with the second driving gear 103.

Meanwhile, the diameters of portions 112*a* and 112*b* of the rotating shaft 112 of the supply auger 111, which correspond to the inlet 107 and the supply port 108, are set to be smaller than the diameters of the other portions. Accordingly, it may be possible to reliably receive the powder 61 from the inlet 107 and to reliably supply the powder from the supply port 108.

Further, a shutter member 120, which opens and closes the supply port 108, is slidably provided at an end portion in the powder supplying member 106 and is pushed by a spring 121 so as to close the supply port 108 as shown in FIGS. 11 and 15. When the toner cartridges 60Y, 60M, 60C, and 60K are mounted on the printer main body 1 as shown in FIG. 5, the shutter member 120 is pushed by a thin shaft-like operating protrusion 122 that is provided in each of the powder supply portions 65Y, 65M, 65C, and 65K of the printer main body 1 so as to protrude. Accordingly, the shutter member is moved to a position where the supply port 108 is opened.

Meanwhile, the toner cartridges 60Y, 60M, 60C, and 60K are formed in the shape of a substantially rectangular parallelepiped box that is elongated in a vertical direction as shown in FIG. 10. In particular, the width of the intermediate portion 81*b* of the new powder storage chamber 81 is gradually decreased, so that the lower end portion 81*c* is formed substantially in a U shape having the smallest width. Accordingly, new powder, which is stored in the new powder storage chambers 81 of the toner cartridges 60Y, 60M, 60C, and 60K, is apt to cohere due to vibration or the like during transport while being biased from the intermediate portion 81*b* over the lower end portion 81*c*.

For this reason, if new powder coheres in the new powder storage chambers 81 and is hardened, there is a concern that hardened powder, which is positioned on the upper outer periphery or the like of the conveying auger 79, does not collapse and cannot be discharged from the outlet 90 even though the toner cartridges 60Y, 60M, 60C, and 60K are mounted on the printer main body 1 and the conveying augers 79 are rotationally driven.

Therefore, this exemplary embodiment includes a plate-like elastic member of which an upper end portion is fixed to an upper end portion in the powder storage unit, a lower end portion becoming a swingable free end is disposed above the agitating-conveying member in the conveying direction, and only a part of the lower end portion comes into contact with the agitating-conveying member and swings. Accordingly, the plate-like elastic member loosens the powder that is positioned at an upper portion of the agitating-conveying member.

That is, as shown in FIG. 1, the plate-like (thin film-like) elastic member 80 for loosening new powder is provided in each of the new powder storage chambers 81 of the toner cartridges 60Y, 60M, 60C, and 60K according to this exemplary embodiment. As the elastic member 80, there is used, for example, a member that is formed in a vertically long rectangular shape and is formed of a miler (registered trademark) film having a thickness of several micrometers to several hundred micrometers and made of a synthetic resin such as PET. However, the elastic member is not limited thereto, and members that are made of other materials and formed in other shapes may be used as the elastic member.

As shown in FIG. 1, the elastic member 80 is formed in a vertically long rectangular shape so as to have a width slightly smaller than the depth of the new powder storage chamber 81.

An upper end portion 131 of the elastic member is fixed to the upper end portion of the inner surface of the side wall 84 of the toner cartridge 60 by means, such as a double-sided tape or adhesion, and a lower end portion 132 of the elastic member extends up to the vicinity of the upper end portion of the conveying auger 79 in the axial direction of the conveying auger. An intermediate portion 133 of the elastic member 80 is curved from the lower end portion of the side wall 84 over the partition wall 83, and comes into contact with the surface of the partition wall 83 along the partition wall 83 of the new powder storage chamber 81 by an elastic restoring force. A portion of the elastic member 80, which is lower than the intermediate portion, becomes a free end that is not fixed to the inner surface of the new powder storage chamber 81.

Further, as shown in FIGS. 1 and 13, first and second tongue pieces 134 and 135 protrude downward from the upstream end portion and the downstream end portion of the lower end portion 132 of the elastic member 80 in the axial direction of the conveying auger 79 (conveying direction) and form a notch 136 therebetween. The first and second tongue pieces 134 and 135 come into contact with the first and second operating portions 94 and 99 that are formed at the conveying auger 79, so that the lower end portion 132 of the elastic member 80 is elastically deformed obliquely upward in FIGS. 1 and 13 at predetermined timing synchronized with the rotation of the conveying auger 79. Accordingly, the powder 61 hardened (cohering) in the new powder storage chamber 81 is loosened.

Furthermore, the toner cartridges 60Y, 60M, 60C, and 60K are adapted to recover waste toner that is discharged from the belt cleaning device 27 and the cleaning devices 11Y, 11M, 11C, and 11K of the printer main body 1.

That is, an inlet 140, through which waste toner discharged from the belt cleaning device 27 and the cleaning devices 11Y, 11M, 11C, and 11K of the printer main body 1 is introduced as shown in FIG. 6, is opened on the back surface of the waste powder storage chamber 82 of each of the toner cartridges 60Y, 60M, 60C, and 60K as shown in FIG. 12. A sealing member 141, which is made of sponge or the like and prevents the leakage of toner, is provided at the outer periphery of the inlet 140. Further, as shown in FIG. 11, the inlet 140 is usually closed by a second shutter member 143 that is pushed by a spring 142.

Furthermore, when the toner cartridges 60Y, 60M, 60C, and 60K are mounted on the printer main body 1 as shown in FIG. 5, the second shutter members 143 are pushed inward by the powder recovery portions 66Y, 66M, 66C, and 66K of the printer main body 1. As a result, the inlets 140 of the toner cartridges 60Y, 60M, 60C, and 60K for the waste toner are opened.

Figure 16:
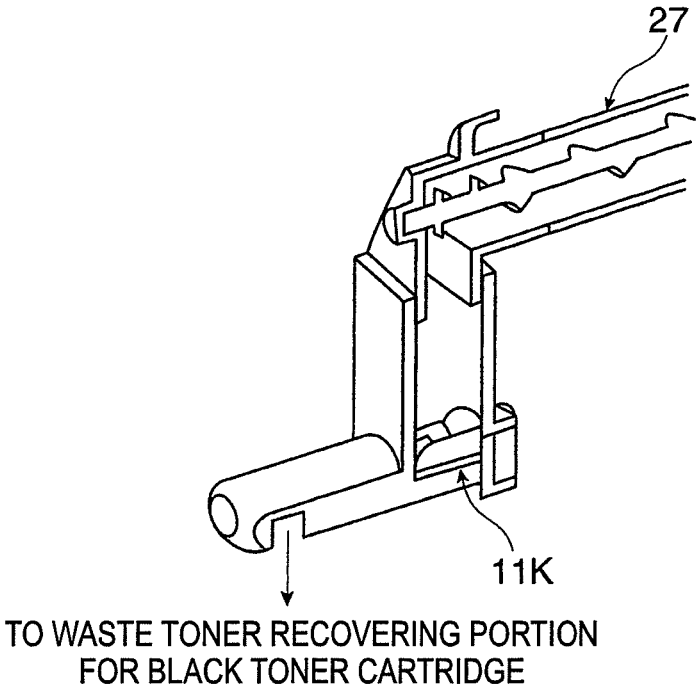
FIG. 16 is a cross-sectional perspective view showing a powder recovery passage where powder is recovered from a black toner cartridge.

Meanwhile, as described above, the black powder recovery portion 66K of the printer main body 1 recovers the waste toner from the belt cleaning device 27 for the intermediate transfer belt 12 as well as the waste toner from the black cleaning device 11K. In this case, since the belt cleaning device 27 for the intermediate transfer belt 12 is positioned immediately above the black cleaning device 11K as shown in FIG. 2, as shown in FIG. 16, the black powder recovery portion 66K makes the waste toner, which is recovered by the belt cleaning device 27 for the intermediate transfer belt 12, join together by the black powder recovery portion 66K that is formed to connect the end portion of the belt cleaning device 27 for the intermediate transfer belt 12 with the end portion of the black cleaning device 11K, and discharges the waste toner to the inlet 140 of the black toner cartridge 60K by a discharge auger of the black cleaning device 11K.

According to the above-mentioned structure, even though the powder stored in the powder storage unit coheres due to vibration or the like during transport, it may be possible to loosen cohering powder and supply the powder without applying a large load to the drive source, which drives the agitating-conveying member, by the followings in the color printer to which the powder storage container according to this exemplary embodiment is applied.

That is, as shown in FIG. 2, in the color printer according to this exemplary embodiment, color toner images are sequentially formed by the respective image forming units 6Y, 6M, 6C, and 6K corresponding to yellow (Y), magenta (M), cyan (C), and black (K); and the respective color toner images formed on the photoreceptor drums 8 of the respective image forming units 6Y, 6M, 6C, and 6K are primarily, sequentially, and multiply transferred to the intermediate transfer belt 12. After that, the toner images are secondarily and collectively transferred to the recording sheet 16 from the intermediate transfer belt 12 at the secondary transfer position and are fixed to the recording sheet 16. Then, as shown in FIG. 4, the recording sheet is discharged onto the discharge tray 22 that is provided at the upper portion of the printer main body 1.

When the respective color toner images are formed by the respective image forming units 6Y, 6M, 6C, and 6K corresponding to yellow (Y), magenta (M), cyan (C), and black (K) in the color printer as shown in FIG. 2, toner in the developing devices 10 of the image forming units 6Y, 6M, 6C, and 6K is gradually consumed, so that toner concentration in the developing devices 10 is reduced. Accordingly, as shown in FIG. 5, new powder 61 including at least corresponding color toner is supplied to the developing devices 10 of the respective image forming units 6Y, 6M, 6C, and 6K from the toner cartridges 60Y, 60M, 60C, and 60K.

Further, when the new powder 61 in the toner cartridges 60Y, 60M, 60C, and 60K is supplied and the new powder storage chambers become empty or become almost empty, the side cover 29 of the printer main body 1 is opened as shown in FIGS. 4 and 5, empty or almost empty toner cartridges 60Y, 60M, 60C, and 60K are taken out from the printer main body 1, and new toner cartridges 60Y, 60M, 60C, and 60K are mounted on the printer main body 1.

When the toner cartridges 60Y, 60M, 60C, and 60K are mounted on the printer main body 1 as shown in FIG. 5, intermediate gears and driving gears, which rotationally drive the conveying augers and the supply augers, mesh with the main body gear of the printer main body 1 and the supply ports of the powder supplying members 106 are opened.

Further, as shown in FIG. 15, the rotational driving forces of the main body gears 104 are transmitted to the first and second driving gears 102 and 103 by rotationally driving the main body gears 104 of the printer main body 1 at predetermined timing in the toner cartridges 60Y, 60M, 60C, and 60K, so that the conveying augers 79 and the supply augers 111 are rotationally driven.

When the conveying auger 79 is rotationally driven, new powder 61, which is positioned at the bottom of the new powder storage chamber 81, is scraped and destroyed in the circumferential direction as shown in FIGS. 1 and 13 by the flat plate portion 94 that is formed at the upstream end portion of the conveying auger 79 in the axial direction as shown in FIG. 14A. The new powder 61, which is scraped and destroyed by the flat plate portion 94, is conveyed to the downstream side by the conveying blade portion 95 that is formed at the middle portion of the conveying auger 79 in the axial direction.

Further, the new powder 61, which is conveyed to the downstream side by the conveying blade portion 95 of the conveying auger 79 in the axial direction, is scooped by the discharge portion 96 of the conveying auger 79 that is formed in the shape of a bucket, and is discharged from the outlet 90 that is formed at the downstream end portion of the conveying auger 79 in the axial direction.

The new powder 61, which is discharged from the outlet 90, is introduced inward from the inlet 107 of the powder supplying member 106 as shown in FIG. 15, is conveyed to the supply port 108 by the supply auger 106 that is provided inside the powder supplying member 106, and is supplied to the developing device 10 from the supply port 108.

Meanwhile, as described above, the toner cartridges 60Y, 60M, 60C, and 60K are formed in the shape of a substantially rectangular parallelepiped box that is elongated in a vertical direction as shown in FIG. 10. In particular, the width of the intermediate portion 81*b* of the new powder storage chamber 81 is gradually decreased, so that the lower end portion 81*c* is formed substantially in a U shape having the smallest width. Accordingly, new powder, which is stored in the new powder storage chambers 81 of the toner cartridges 60Y, 60M, 60C, and 60K, is apt to cohere due to vibration or the like during transport while being biased from the intermediate portion 81*b* over the lower end portion 81*c*.

For this reason, if new powder coheres in the new powder storage chambers 81 and becomes firm, there is a concern that hardened powder, which is positioned on the upper outer periphery or the like of the conveying auger 79, does not collapse even though the toner cartridges 60Y, 60M, 60C, and 60K are mounted on the printer main body 1 and the conveying augers 79 are rotationally driven.

Each of the toner cartridges 60Y, 60M, 60C, and 60K according to this exemplary embodiment includes the elastic member 80 in the new powder storage chamber 81 as shown in FIG. 1. As shown in FIGS. 1 and 13, only the upper end portion 131 of the elastic member 80 is fixed to the inner surface of the side wall 84 of the new powder storage chamber, the intermediate portion 133 and the lower end portion 132 of the elastic member are curved along the inner surface of the partition wall 83*a* of the new powder storage chamber 81, and the lower end portion 132 as the free end of the elastic member is positioned on the outer periphery of the conveying auger 79 and is disposed parallel to the axial direction.

Further, as shown in FIGS. 1 and 13, the first and second tongue pieces 134 and 135 are formed at the lower end of the elastic member 80. The first and second tongue pieces 134 and 135 come into contact with the first and second operating portions 94 and 99 of the conveying auger 79, so that the lower end portion 132 of the elastic member 80 is elastically deformed obliquely upward in FIGS. 1 and 13 and is bent. For this reason, as shown in FIG. 1, as for each of the toner cartridges 60Y, 60M, 60C, and 60K, when the conveying auger 79 is rotationally driven at predetermined timing in order to supply new powder 61, the first and second operating portions 94 and 99 of the conveying auger 79 come into contact with the first and second tongue pieces 134 and 135 formed at the lower end of the elastic member 80 and the lower end portion 132 of the elastic member 80 is elastically deformed obliquely upward in FIGS. 1 and 13 and is bent. Accordingly, the new powder 61, which is positioned above the conveying auger 79 in the new powder storage chamber 81, is loosened.

As a result, even if new powder 61 stored in the new powder storage chamber 81 of each of the toner cartridges 60Y, 60M, 60C, and 60K coheres and is hardened, the new powder 61, which coheres and is hardened in the new powder storage chamber 81, is loosened by the elastic member 80, which is elastically deformed in synchronization with the rotation of the conveying auger 79, and is supplied to the conveying auger 79. Accordingly, when the conveying auger 79 is rotationally driven, it may be possible to reliably discharge new powder from the outlet 90, which is formed at the bottom in the new powder storage chamber 81, and to supply the new powder to the developing device 10.

Further, the first operating portion of the conveying auger 79 is formed in the shape of a flat plate that extends in the radial direction. Accordingly, the first tongue piece 134 of the elastic member 80 is temporarily lifted up only when the first operating portion 94 of the conveying auger 79 passes, and immediately returns to an original state.

Meanwhile, since the second operating portion 99 of the conveying auger 79 is formed in the shape of an arc that is formed in the outer circumferential direction, the second tongue piece 135 of the elastic member 80 is maintained to be lifted up while the second operating portion 99 of the conveying auger 79 passes. During this time, the new powder 61 is conveyed in the axial direction by the conveying auger 79. Accordingly, the powder 61 loosened by the second operating portion is supplied while being dropped to the portion of the conveying blade portion 95 positioned in the middle of the conveying auger 79 by the elastic member 80 of which the first tongue piece 134 returns to an original position and the lower end portion 132 is inclined to the axial direction of the conveying auger 79 at a position where the second tongue piece 135 is moved upward. Then, the powder is reliably conveyed to the downstream side by the conveying blade portion 95, and is reliably supplied while being dropped to the outlet 90.

In addition, the second tongue piece 135 of the elastic member 80 returns to an original position after the second operating portion 99 of the conveying auger 79 passes.

Meanwhile, when the elastic member 80 is elastically deformed so as to move upward, there is a concern that new powder 61 gets into a space between the back side of the elastic member 80 and the partition wall 83. However, if the new powder 61, which is positioned above the conveying auger 79, is loosened by the elastic member 80, the new powder 61 getting into back side of the elastic member 80 is also dropped and supplied along the surface of the inclined partition wall 83*a* by the elastic deformation of the lower end portion of the elastic member 80 which is caused by the conveying operation of the conveying auger 79.

In this exemplary embodiment, the entire lower end portion 132 of the elastic member 80 is not moved upward by the conveying auger 79, and only the tongue pieces 134 and 135, which are a part of the lower end portion 132 of the elastic member 80, may be partially moved by the first and second tongue pieces formed at the lower end portion of the elastic member 80. Even though the new powder 61 positioned on the conveying auger 79 coheres, it may be possible to avoid that a large load (weight) is applied by the new powder 61 positioned on the elastic member 80, large drive torque is required to rotationally drive the conveying auger 79, or new powder 61 cannot functionally be supplied since the conveying auger 79 cannot be rotated.

The foregoing description of the exemplary embodiment of the present invention has been provided for the purpose of illustration and description. It is not intended to be exhaustive or to limit the invention to the precise forms disclosed. Obviously, many modifications and various will be apparent to practitioners skilled in the art. The embodiments were chosen and described in order to best explain the principles of the invention and its practical application, thereby enabling other skilled in the art to understand the invention for various embodiments and with the various modifications as are suited to the particular use contemplated. It is intended that the scope of the invention be defined by the following claims and their equivalents.

What is claimed is:

1. A powder storage container comprising:

a powder storage unit that stores powder;

a conveying member that is rotatably disposed in the powder storage unit and conveys the powder stored in the powder storage unit to an outlet; and an elastic member that includes:

an upper end portion fixed to the inside of the powder storage unit; and a lower end portion which is a swingable free end and is disposed above the conveying member; and wherein a part of the lower end portion along the conveying direction of the conveying member is configured to contact with the conveying member to be elastically deformed, wherein the conveying member includes a flat plate portion as a first operating portion that is positioned on the upstream side in the conveying direction of the conveying member, loosens powder positioned above the conveying member, and is disposed so as to extend toward the outside in a radial direction of the conveying member, a spiral conveying blade portion that is positioned at a middle portion of the conveying member in the conveying direction and conveys powder, and a discharge portion as a second operating portion that is positioned on the downstream side in the conveying direction of the conveying member, discharges powder to the outlet, and is formed in an arc shape along an outer peripheral surface of the conveying member.

2. The powder storage container according to claim 1, wherein an inclined surface, which extends toward the conveying member, is formed on the powder storage container, and wherein the elastic member is disposed along the inclined surface.

3. The powder storage container according to claim 1, wherein the elastic member is configured to contact with an upstream end portion of the conveying member in a conveying direction of the conveying member, and to be elastically deformed.

4. The powder storage container according to claim 1, wherein the elastic member is configured to contact with both upstream and downstream end portions of the conveying member in a conveying direction of the conveying member and to be elastically deformed.

5. The powder storage container according to claim 1, wherein a notch, which faces an upper side in a direction crossing the conveying direction of the conveying member from a lower end portion of the elastic member, is formed at a middle portion of the elastic member.

6. The powder storage container according to claim 1, wherein a notch is provided at a position corresponding to the spiral conveying blade portion of the conveying member.

7. A powder storage container comprising:

a powder storage unit that stores powder;

a conveying member that is rotatably disposed in the powder storage unit and conveys the powder stored in the powder storage unit to an outlet; and an elastic member that includes:

an upper end portion fixed to the inside of the powder storage unit; and a lower end portion which is a swingable free end and is disposed above the conveying member; and wherein a part of the lower end portion along the conveying direction of the conveying member is configured to contact with the conveying member to be elastically deformed, wherein a discharge portion of the conveying member is disposed at a position to close the outlet at the time of shipment.

8. The powder storage container according to claim 7, wherein an inclined surface, which extends toward the conveying member, is formed on the powder storage container, and wherein the elastic member is disposed along the inclined surface.

9. The powder storage container according to claim 7, wherein the elastic member is configured to contact with an upstream end portion of the conveying member in a conveying direction of the conveying member, and to be elastically deformed.

10. The powder storage container according to claim 7, wherein the elastic member is configured to contact with both upstream and downstream end portions of the conveying member in a conveying direction of the conveying member and to be elastically deformed.

11. The powder storage container according to claim 7, wherein a notch, which faces an upper side in a direction crossing the conveying direction of the conveying member from a lower end portion of the elastic member, is formed at a middle portion of the elastic member.

* * * * *